US006490842B2

(12) United States Patent
Emmons

(10) Patent No.: US 6,490,842 B2
(45) Date of Patent: Dec. 10, 2002

(54) TRACTION PAD FOR MANEUVERING ON A ROOF

(76) Inventor: Daniel J. Emmons, W240 N2578 Eastparkway Meadow Cir. #8, Pewaukee, WI (US) 53072

( * ) Notice: Subject to any disclaimer, the term of this patent is extended or adjusted under 35 U.S.C. 154(b) by 21 days.

(21) Appl. No.: 09/776,153

(22) Filed: Feb. 2, 2001

(65) Prior Publication Data

US 2001/0045078 A1 Nov. 29, 2001

Related U.S. Application Data

(60) Provisional application No. 60/182,127, filed on Feb. 12, 2000.

(51) Int. Cl.[7] ..... E04D 15/00

(52) U.S. Cl. ..... 52/749.12; 52/749.1; 52/127.5; 182/45

(58) Field of Search ..... 52/749.1, 749.11, 52/749.12, 749.13, 127.5, 746.11; 248/237; 182/45, 230; 2/24, 62

(56) References Cited

U.S. PATENT DOCUMENTS 1,454,401 A * 5/1923 O'Neill ..... 182/129
1,478,682 A * 12/1923 Stansberry ..... 182/45
4,230,202 A * 10/1980 Kudra, III ..... 182/194
4,346,784 A * 8/1982 Hammond ..... 182/230
4,763,756 A * 8/1988 Horan ..... 182/20
4,789,046 A * 12/1988 McDowall ..... 182/230
4,840,824 A * 6/1989 Davis ..... 264/173.17
5,114,387 A * 5/1992 Keppler ..... 434/253
5,119,904 A * 6/1992 Dierolf ..... 182/230
5,415,109 A * 5/1995 McBride ..... 108/57.29
5,943,839 A * 8/1999 Miller ..... 52/748.1
6,170,222 B1 * 1/2001 Miller ..... 52/749.12

FOREIGN PATENT DOCUMENTS

DE 4000619 * 7/1991

* cited by examiner

*Primary Examiner*—Lanna Mai
*Assistant Examiner*—Winnie Yip
(74) *Attorney, Agent, or Firm*—Donald J. Ersler

(57) ABSTRACT

A traction pad for maneuvering on a roof includes a base layer, traction layer, at least two traction cross members, and two end members. A bottom side of the base layer contacts the roof and the traction layer is attached to a top side of the base layer. The at least two traction cross members are attached to a top side of the traction layer along a length thereof. The two end members are attached to a top side of the traction layer, adjacent the ends of the at least two traction cross members. A pair of lifting handles are preferably attached to a top side of the two end members. The top side of the traction layer is preferably painted with a paint having sand dissolved therein.

5 Claims, 2 Drawing Sheets

TRACTION PAD FOR MANEUVERING ON A ROOF

CROSS-REFERENCES TO RELATED APPLICATIONS

This is a utility application taking priority from provisional application, serial No. 60/182,127 filed on Feb. 12, 2000.

BACKGROUND OF THE INVENTION

1. Field of the Invention

The present invention relates generally to traction pads and more specifically to a traction pad for maneuvering on a roof which allows a roofer to have a non-slip pad for accomplishing roof related repairs.

2. Discussion of the Prior Art

A problem frequently encountered while doing roof related repairs (such as chimney repair, painting, installing siding, installing antennas, or installing satellite dishes) on a sloped roof is remaining in the same position while doing the repairs without slipping down the roof. Currently, there appears to be no device on the market which may be placed under the roofer so that they may maintain their position relative to the sloped roof. The consequences of a roofer slipping off a sloped roof may be spinal paralysis and even death.

Accordingly, there is a clearly felt need in the art for a traction pad for maneuvering on a roof which provides a traction surface for a user to perform repairs on a sloped roof surface.

SUMMARY OF THE INVENTION

The present invention provides a traction surface for roof related repairs of a sloped roof. According to the present invention, a traction pad for maneuvering on a roof includes a base layer, traction layer, at least two traction cross members, and two end members. The base and traction layers are preferably rectangular in shape. A bottom side of the base layer contacts the roof and the traction layer is attached to a top side of the base layer. The at least two traction cross members are attached to a top side of the traction layer along a length thereof. The two end members are attached to a top side of the traction layer, adjacent the ends of the at least two traction cross members. Preferably, a pair of lifting handles are attached to a top side of the two end members. The top side of the traction layer is preferably painted with a paint having sand dissolved therein.

Accordingly, it is an object of the present invention to provide a traction pad for maneuvering on a roof which provides a non-slip surface for a roofer to perform roof related repairs.

Finally, it is another object of the present invention to provide a traction pad for maneuvering on a roof which may be used on asphalt shingle roofs as well as ceramic title roofs.

These and additional objects, advantages, features and benefits of the present invention will become apparent from the following specification.

DETAILED DESCRIPTION OF THE PREFERRED EMBODIMENTS

Figure 1:
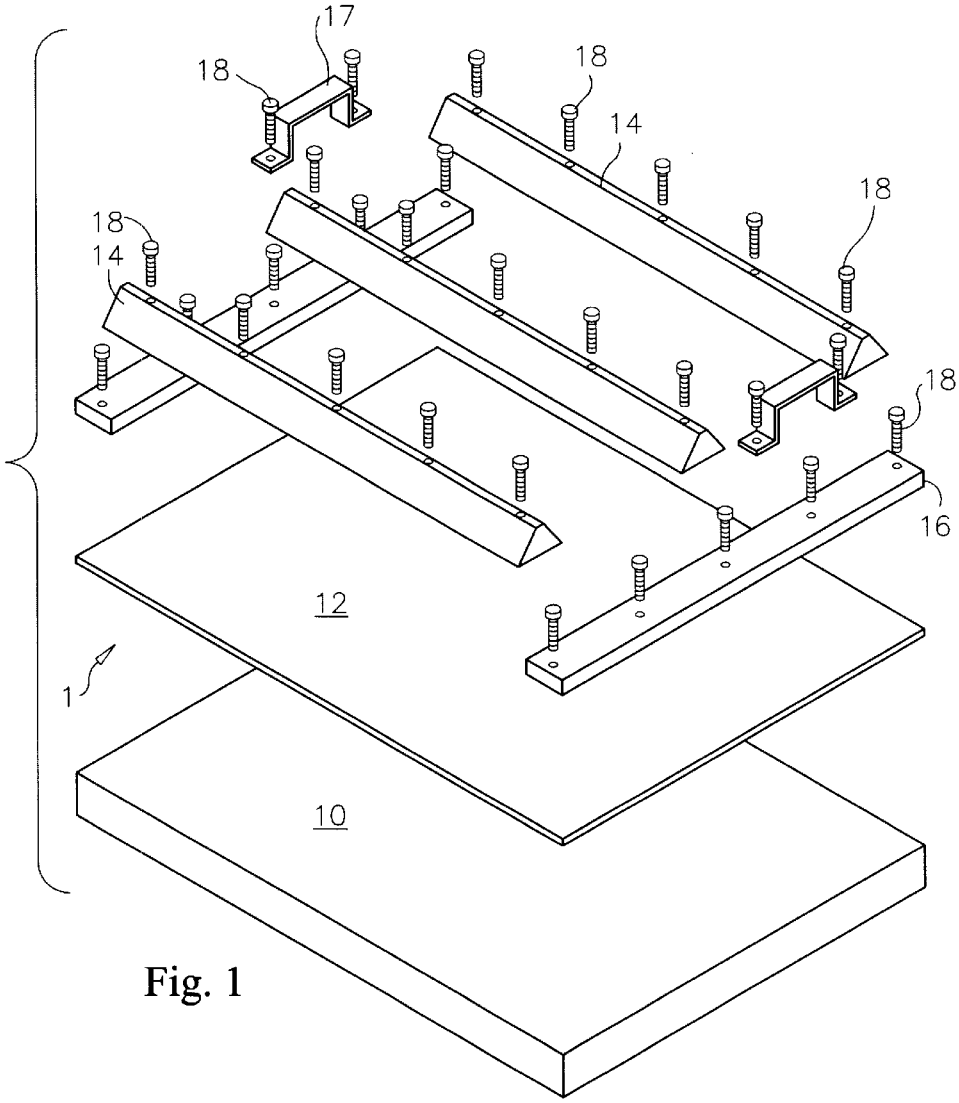
FIG. 1 is an exploded perspective view of a traction pad for maneuvering on a roof in accordance with the present invention.
Figure 2:
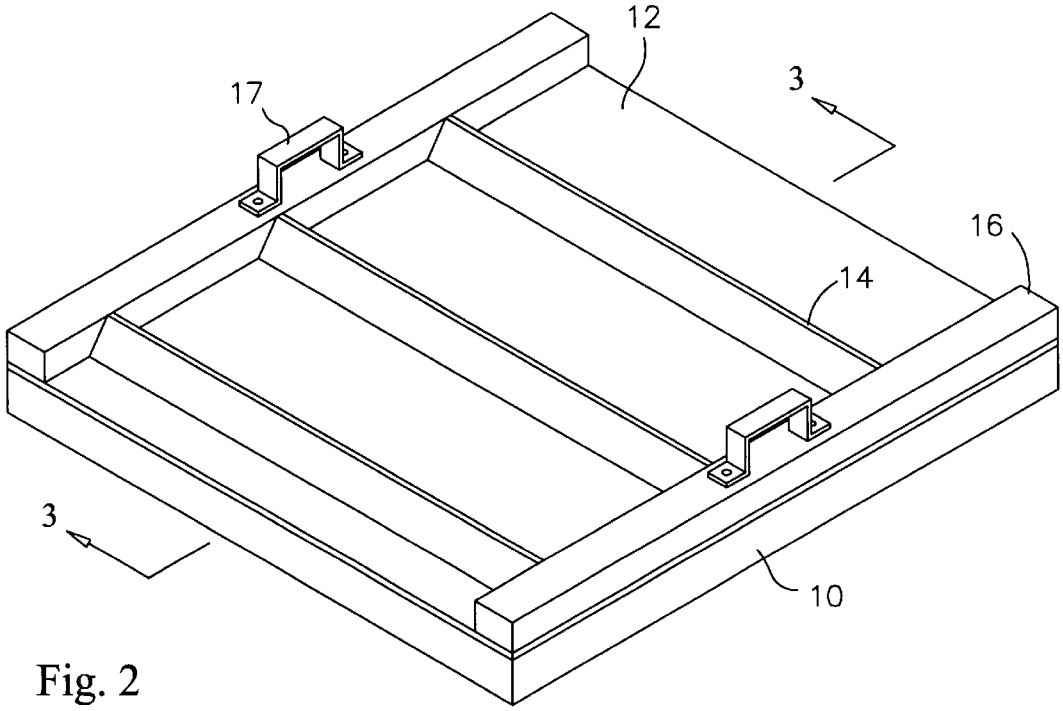
FIG. 2 is a perspective view of a traction pad for maneuvering on a in accordance with the present invention.

With reference now to the drawings, and particularly to FIG. 1, there is shown an exploded perspective view of the traction pad for maneuvering on a roof 1. With reference to FIG. 2, a traction pad for maneuvering on a roof 1 includes a base layer 10, traction layer 12, at least two traction cross members 14, and two end members 16. The base and traction layers are preferably rectangular in shape. A bottom side of the base layer 10 contacts the roof and the traction layer 12 is preferably attached to a top side of the base layer 10 with silicon adhesive, rubber contact cement or any other suitable fastening compound or method. The at least two traction cross members 14 are preferably attached to a top side of the traction layer 12 with lag screws 18, but other suitable fasteners or fastening methods may also be used. Each traction cross member 14 is available for supporting the roofer's feet.

Figure 5:
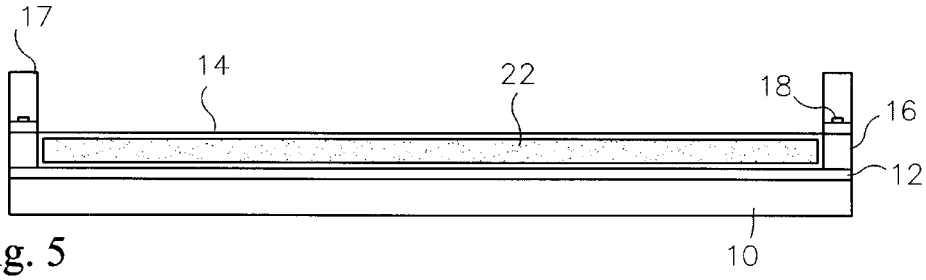
FIG. 5 is a front end view of the traction pad for maneuvering on a roof in accordance with the present invention.
Figure 3:
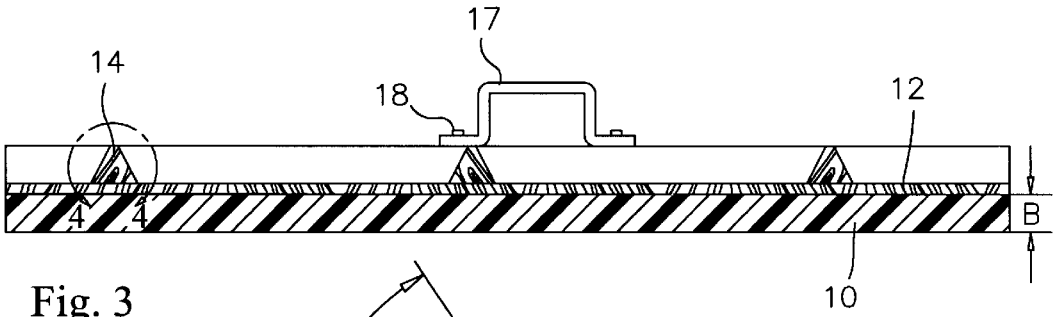
FIG. 3 is a cross-sectional view of a traction pad for maneuvering on a roof in accordance with the present invention.
Figure 4:
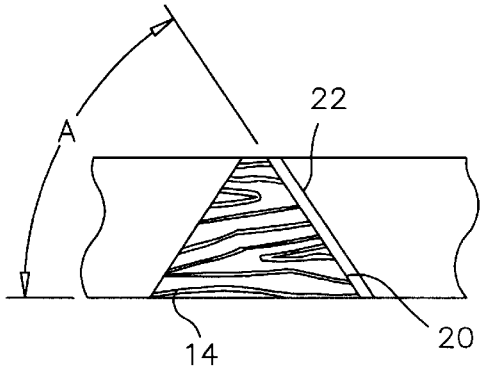
FIG. 4 is an enlarged cross-sectional view of a traction cross member in a dance with the present invention.

With reference to FIGS. 3–5, a front surface 20 of each traction cross member 14 is preferably sloped at an angle A. The following dimension is given by way of example and not by limitation. Angle "A" preferably has a range of between 40–60 degrees. A traction strip 22 is preferably attached to the front surface 20 of each traction cross member 14. The traction strip 22 has a roughened surface which provides a non-slip surface for a roofer's shoe. The two end members 16 are attached to a top side of the traction layer 12, adjacent the ends of the at least two traction cross members 14. Each end member 16 is preferably attached to a top side of the traction layer 12 with lag screws 18, but other suitable fasteners or fastening methods may also be used. Each end member 16 prevents a roofer's foot from sliding off the traction layer 12. Each lifting handle 17 is preferably attached to a top side of a single end member 16 with lag screws 18, but other suitable fasteners or fastening methods may also be used.

The base layer 10 is preferably fabricated from foam. A "1550" foam has been found to have the suitable properties of hardness and compression for use as the base layer 10. Other foams may also be used for the base layer 10. The thickness of the base layer 10 is dimension "B." The following dimensions are given by way of example and not by way of limitation. Dimension "B" is preferably 2.0 inches for asphalt shingle roofs and 4.0 inches for ceramic title roofs. The traction layer 12 is preferably fabricated from a finished plywood board, other materials may also be used. The at least two cross members 14 and pair of end members 16 are preferably fabricated from wood, other materials may also be used. The traction layer 12 is preferably painted with a primer and then coated with a paint having sand dissolved therein, but other coatings may also be used. The sand provides traction to a roofer's feet when the roofer is positioning themselves between each traction cross member 14. The traction pad for maneuvering on a roof 1 may also be used as a work surface on flat roofs, or for any other appropriate application.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A traction pad for maneuvering on a roof comprising:

a base layer;

a traction layer being fastened to said base layer said traction layer having two ends and two sides; and at least two traction cross members being attached to said traction layer, a front surface of each one of said at least two traction cross members being sloped to provide traction for a user's feet;

a first end member being attached adjacent to one end of each said traction cross members;

a second end member being attached adjacent to the other end of each said traction cross members;

said first and second end members extending from one end to another end of said traction layer and attached adjacent to two sides of said traction layer;

a traction strip being applied to said front surface of each said traction cross member;

a lifting handle being attached to each said end member; and a top of said traction layer being coated with a paint having sand mixed therein.

2. The traction pad for maneuvering on a roof of claim 1, wherein:

said at least two traction cross members, said two end members, and said two handles being attached to said traction layer with screws.

3. The traction pad for maneuvering on a roof of claim 1, further comprising:

said base layer being fabricated from a foam material.

4. A traction pad for maneuvering on a roof comprising;

a base layer being fabricated from a foam material;

a traction layer being fastened to said base layer said traction layer having two ends and two sides; and at least two traction cross members being attached to said traction layer, a front surface of each one of said at least two traction cross members being sloped to provide traction for a user's feet;

a first end member being attached adjacent to one end of each said traction cross members;

a second end member being attached adjacent to the other end of each said traction cross members;

said first and second end members extending from one end to another end of said traction layer and attached adjacent to two sides of said traction layer;

a traction strip being applied to said front surface of each said traction cross member;

a lifting handle being attached to each said end member; and a top of said traction layer being coated with a paint having sand mixed therein.

5. The traction pad for maneuvering on a roof of claim 4 wherein:

said at least two traction cross members, said two end members, and said two handles being attached to said traction layer with screws.

* * * * *